United States Patent [19]

Cardillo et al.

[11] Patent Number: 4,765,623

[45] Date of Patent: Aug. 23, 1988

[54] TALKING CRYSTAL BALL TOY

[76] Inventors: Gary J. Cardillo; Douglas R. Cahill, both of P.O. Box 500, Unionville, Conn. 06085

[21] Appl. No.: 155,375

[22] Filed: Feb. 12, 1988

[51] Int. Cl.[4] ..... A63F 9/18

[52] U.S. Cl. ..... 273/161; 273/138 A

[58] Field of Search ..... 273/161, 138 A, 1 E; 446/175

[56] References Cited

U.S. PATENT DOCUMENTS

| | | | |
|---|---|---|---|
| 2,827,298 | 3/1958 | Peters | 273/161 |
| 3,798,833 | 3/1974 | Campbell | 273/161 |
| 4,072,314 | 2/1978 | Rosen et al. | 273/161 |
| 4,185,170 | 1/1980 | Morino et al. | 364/710 |

*Primary Examiner*—Maryann Lastova

*Attorney, Agent, or Firm*—Peter R. Bahn

[57] ABSTRACT

A talking crystal ball toy which is activated by a double pass of the operator's hands over a photosensor to give a randomly selected verbal response to a question asked by the operator.

8 Claims, 3 Drawing Sheets

TALKING CRYSTAL BALL TOY

FIELD OF INVENTION

This invention is an optoelectronic talking crystal ball toy.

BACKGROUND OF THE INVENTION

The oracular crytal ball which advises a human being as to how he should conduct his affairs has long been a symbol of human interest in the magical properties of certain inanimate substances. This invention simulates for children, and possibly superstitious adults, the experience of consulting a talking crystal ball for advice.

SUMMARY OF THE INVENTION

A clear plastic ball is mounted on a base. A photodiode is located at the base of the plastic sphere. When the operator passes his hands over the sphere once, a speech synthesizer circuit inside the base is activated. When the user passes his hands over the sphere a second time, the speech synthesizer circuit randomly selects one of twenty eight digitally recorded answers to the type of questions a person is likely to ask of a crystal ball. The answer is played through a speaker mounted in the base.

DETAILED DESCRIPTION OF THE INVENTION

Figure 1:
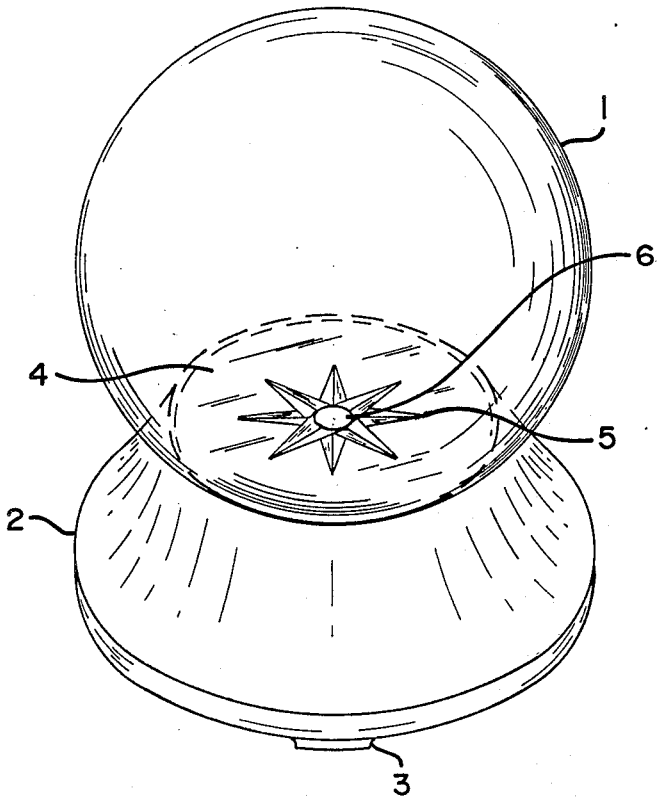
FIG. 1 shows a front elevated view of the talking crytal ball toy.

FIG. 1 shows a molded transparent plastic sphere 1 mounted on a molded opaque plastic base 2 which possesses three integral feet 3, only one of which is shown.

At the bottom of the sphere is a silvered platform 4 having at its center a silvered holographic photograph 5. The photograph shown in FIG. 1 is an eight point compass star but any circularly symmetric hologram or picture will do as the picture serves in a decorative function.

At the center of the compass star in FIG. 1 is located a half-silvered mirror film 6 which functions as a port for the entrance of light into the base of the toy and onto a photodiode positioned just under the half-silvered mirrored film.

Figure 2:
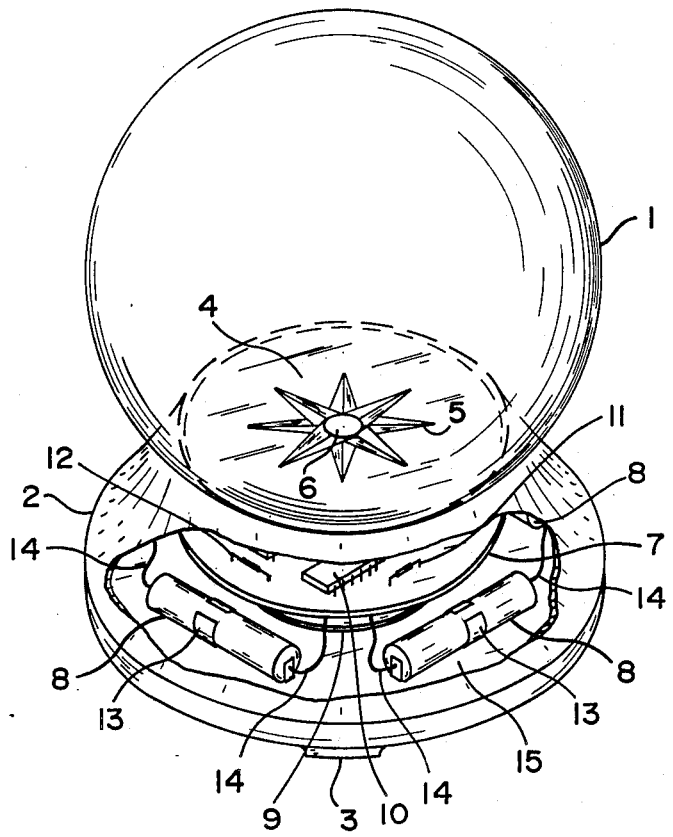
FIG. 2 shows a front elevated view of the toy with a portion of the base cut away to show placement of several of the electronic components of the talking crystal ball toy.

FIG. 2 shows the same view of the crystal ball toy as FIG. 1 but with a portion of the base cut away. It is seen that a circuit board 7 is located under the platform 4. Mounted on the circuit board 7 is shown a main component of this circuit, a Texas Instruments TSP50C41 speech synthesizer chip 10 or its equivalent. Also shown mounted on the circuit board 7 are two of the resistors 11 and 12 that are part of this circuit.

Below the circuit board 7 are shown two of the four 1.5 v batteries 8 that power this circuit. The batteries 8 are hooked together in series and to the circuit board by insulated wire 14. The batteries 8 are physically held in place by standard 1.5 v battery holders 13 arranged quadrangularly around the circuit board 7 which is circular.

The battery holders 13, in turn are mounted on a floor 15 of the base. Also mounted to the base floor 15 is an electrical speaker 9. The floor 15 is made of masonite and has holes drilled through it to allow sound emission from the speaker 9.

Figure 3:
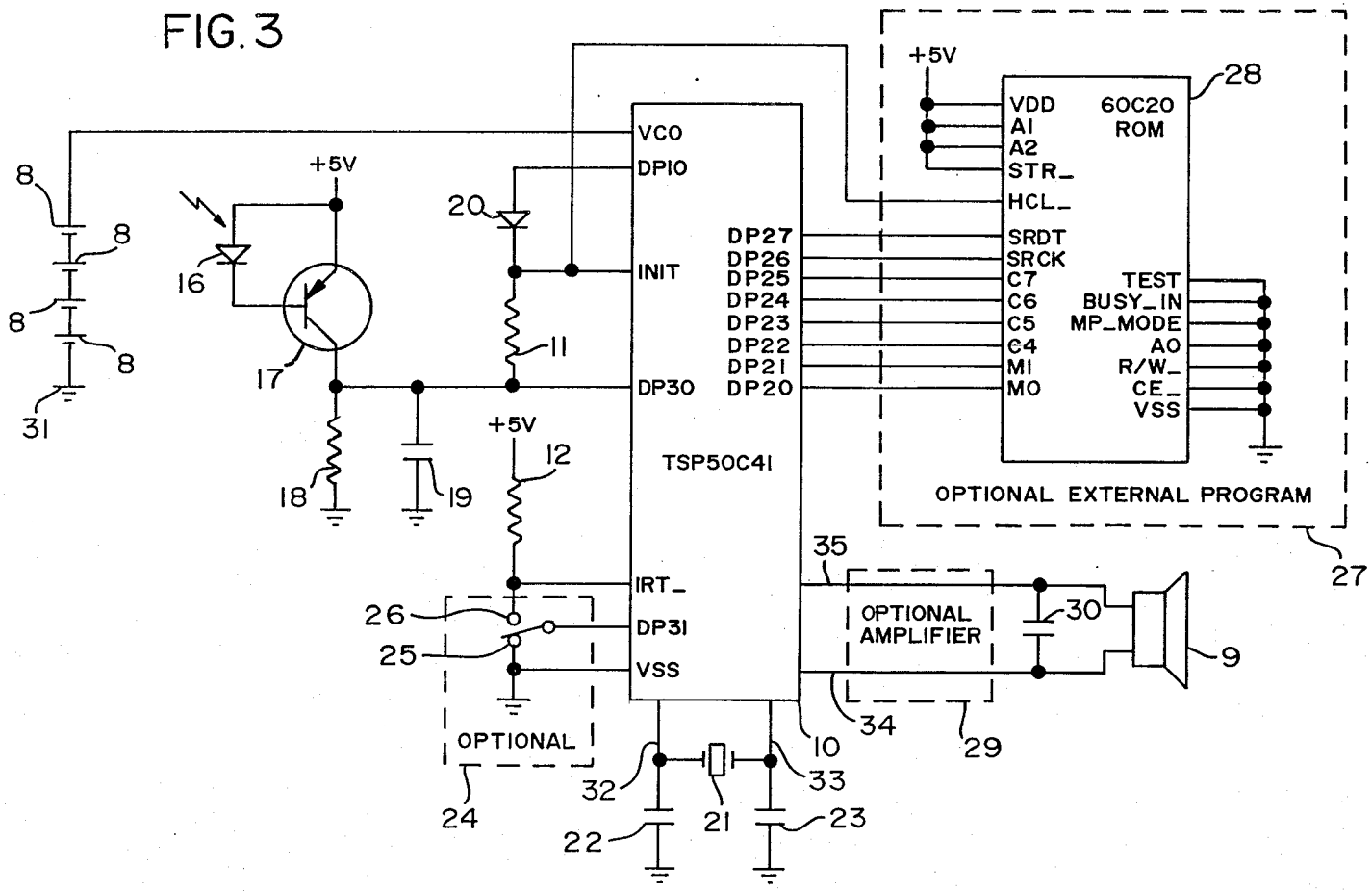
FIG. 3 shows a schematic diagram of the optoelectronic circuit for the talking crystal ball toy.

FIG. 3 shows a schematic diagram for the optoelectronic circuit of this talking crystal ball toy. The circuit is powered by four 1.5 v AA batteries 8. Ground is indicated by the standard symbol 31. The photodiode 16 functions as a photosensor switch for the circuit.

The photodiode 16 is normally in an illuminated state thereby causing a 2N3906 (PNP type) transistor 17 to be saturated, thereby causing a 47K ohm resistor 18 to have a high voltage. This keeps the DP30 terminal of a Texas Intruments TSP50C41 speech synthesizer chip 10 in a high voltage state. The normally illuminated condition also causes the INIT terminal of the chip to have a high voltage and the DP10 terminal of the chip to have a low voltage because of a IN4148 diode 20.

Upon interruption of light to photodiode 16, the transistor 17 is turned off, causing the resistor 18 to go to ground. This in turn pulls the INIT terminal voltage low. The first time the INIT circuit goes low causes the DP10 terminal to go high.

At this time the internal microprocessor of the chip 10 is running, but no speech has resulted. No speech will result until the incident light is again interrupted. The second light interruption must take place within approximately three seconds or the internal microprocessor will again shut down and require a double pass initiation. If the incident light is interrupted within the three second period, then terminal DP30 is caused to go low the second time, which initiates the internal speech synthesis program and hardware to emit at random one of twenty four pre-recorded verbal responses that have been digitally stored in the chip 10.

At the termination of the verbal response via a speaker 9, the DP10 terminal automatically returns to a low state, and the process has to be repeated in order to initiate a second verbal response.

The TSP50C41 chip is programmed to randomly select just one verbal phrase each time the speech synthesizer facility is initiated. Normally the array of responses are all pre-programmed on the TSP50C41 chip 10. However, this circuit allows an option to put additional messages on an optional external program 27 utilizing a Texas Instruments 60C20 ROM chip 28, or its equivalent. The ROM chip 28 can be programmed in a foreign language, for example Japanese. When it is desired to use the optional responses from the ROM chip 28 in lieu of the on-board responses from the main chip 10, then the DP31 terminal on the main chip must be changed from a grounded connection 25 to a plus connection 26, as shown in the optional switch circuit 24.

The speed at which the voice response of the chip 10 is synthesized is controlled by the frequency of an external oscillator at terminals 32 and 33 comprised of a 3.07 Mhz crystal 21 and two 33 Pf capacitors 22 and 23. The external oscillator frequency affects the tonal quality of the voice response.

The TSP50C41 chip 10 shown in FIG. 3 has enough audio output power through terminals 34 and 35 to drive directly a 50 ohm speaker 9. If more power is desired, an optional amplifier 29 can be installed, and the 50 ohm speaker changed to an 8 ohm speaker. For the 50 ohm speaker, a 1 uf capacitor 30 is connected across the speaker leads.

The power source for this circuit, four 1.5 v batteries in series, gives a nominal voltage range of between 4 to 6 volts DC for a nominal voltage of 5 volts as depicted in FIG. 3.

In the present embodiment of this invention, the voice responses which are digitally recorded in the TSP50C41 chip are as follows:

"Yes."
"No."
"Concentrate and ask again."
"Without a doubt."
"Be more specific."
"Possibilities are excellent."
"Not a chance."
"Have someone else ask."
"Not really."
"It is not destined."
"It is not in the stars."
"Excellent chances of success."
"My sources say yes."
"My sources say no."
"My sources say without a doubt."
"My sources say possibilities are excellent."
"The Spirits predict yes."
"The Spirits predict no."
"The Spirits predict excellent chances of success."
"Absolutely."
"Very doubtful."
"Unpredictable."
"It is destined."
"It is very doubtful."
"It will come to pass."
"It doesn't look good."
"Consult me later."
"The images are cloudy."

The circuit in FIG. 3 is shown to also contain a 0.22 uf capacitor 19 and an IN4148 diode 20. Resistor 11 has a value of 100 K ohms and resistor 12 has a value of 10 K ohms.

The terminal pins of the Texas Instruments TSP50C41 chip 10 possess the following functions. The INIT pin initializes input. When this pin is low, the chip is initialized and goes into a low power mode. VSS is a ground pin. The IRT pin is a ready for data output. The DP10, DP30, DP31, and DP20 through DP27 pins are data bus points. The IRT goes high as data in the data register of the chp 10 is read on the data bus DP pins. VCO is the positive voltage pin.

The various functions of the Texas Instruments 60C20 ROM chip be found in data manuals for such component.

The photosensor in the circuit disclosed in FIG. 3 is comprised of an array of four amorphous silicon photovoltaic cells of about 2.4 v total output in series in which the array of photovoltaic cells is acting as a photodiode. In an unilluminated condition, a silicon cell does not conduct electric current, whereas in an illuminated condition, a photovoltaic cell does conduct current but only in one direction. Thus, when an independent voltage is applied across a photovoltaic cell, the photovoltaic cell becomes a photodiode.

In FIG. 3, the photovoltaic cell acts as a photodiode light switch. The transistor in FIG. 3 functions as a voltage-change switch. Together the photovoltaic cell - photodiode and the transistor function as a light activated voltage switch.

The Texas Instruments TSP50C41 chip 10 is a 64K bit speech synthesis computer integrated on a single chip. The Texas Instruments TSP60C20 ROM is a 256K bit read-only-memory capable of approximately 100 total voice responses and can digitally store foreign language or alternate/additional English voice responses.

What is claimed is:

1. A talking crystal ball toy comprising a light-permeable sphere mounted on a base which contains a photosensitive element from which a double interruption of light activates a speech synthesis circuit which generates an an audio output of a digitally pre-recorded voice response to a question asked of the said crystal ball.

2. A talking crystal ball toy as described in claim 1 wherein the said voice response is randomly chosen from a total of twenty eight possible pre-recorded voice responses.

3. A talking crystal ball toy as described in claim 1 wherein the said photosensitive element is a photodiode.

4. A talking crystal ball toy as described in claim 1 wherein the said speech synthesis circuit contains a Texas Instruments TSP50C41 speech synthesis chip.

5. A talking crystal ball toy as described in claim 1 wherein the circuit has an optional external program which contains a TI 60C20 ROM with alternate digitally pre-recorded voice responses.

6. A talking crystal ball toy as described in claim 1 wherein a photovoltaic cell is used as a photodiode.

7. A talking crystal ball toy as described in claim 1 wherein additional audio output is generated with an optional amplifier.

8. A talking crystal ball toy as described in claim 1 wherein a photovoltaic cell - photodiode and a PNP transistor in combination function as a light activated voltage switch.

* * * * *